United States Patent [19]

Berger, Jr. et al.

[11] 3,970,299

[45] July 20, 1976

[54] SHEET REGISTRY DEVICE

[75] Inventors: Emil J. Berger, Jr., Hatfield, Pa.; John M. Mitchard, Cherry Hill, N.J.

[73] Assignee: Union Camp Corporation, Wayne, N.J.

[22] Filed: Dec. 13, 1974

[21] Appl. No.: 532,648

[52] U.S. Cl. ..... 271/250; 271/233; 271/236

[51] Int. Cl.[2] ..... B65H 9/10

[58] Field of Search ..... 271/251, 250, 248, 236, 271/237, 238, 233

[56] References Cited

UNITED STATES PATENTS

| | | | |
|---|---|---|---|
| 2,888,261 | 5/1959 | Barnes | 271/251 |
| 3,663,011 | 5/1972 | Mowry et al. | 271/236 |

FOREIGN PATENTS OR APPLICATIONS

| | | | |
|---|---|---|---|
| 952,712 | 3/1964 | United Kingdom | 271/251 |

OTHER PUBLICATIONS

Gutteling, J. "Document Aligning Device For Two Transport Directions" *IBM Technical Disclosure Bulletin*, vol. 16, No. 11, Apr. 1974, pp. 3676, 3677.

*Primary Examiner*—Evon C. Blunk
*Assistant Examiner*—Bruce H. Stoner, Jr.
*Attorney, Agent, or Firm*—Charles P. Bauer

[57] ABSTRACT

A sheet registry device for use in a sheet-handling machine in which a constantly rotating brush exerts a force on the sheet to urge the sheet against a side guide and properly register such sheet in a cross-machine direction while the sheet is being removed in a direction parallel to the guiding surface of the side guide.

1 Claim, 5 Drawing Figures

Fig.2.
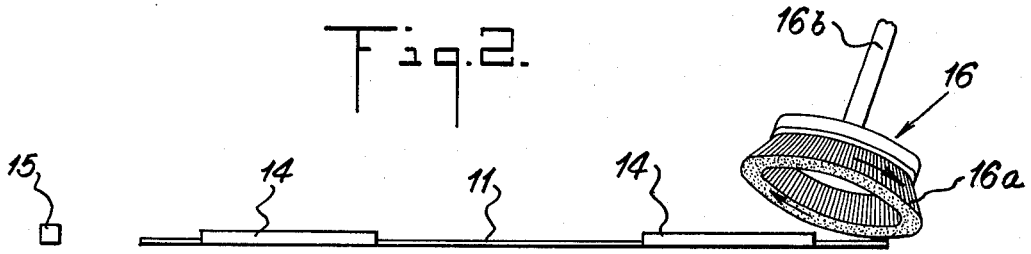
Fig.3.
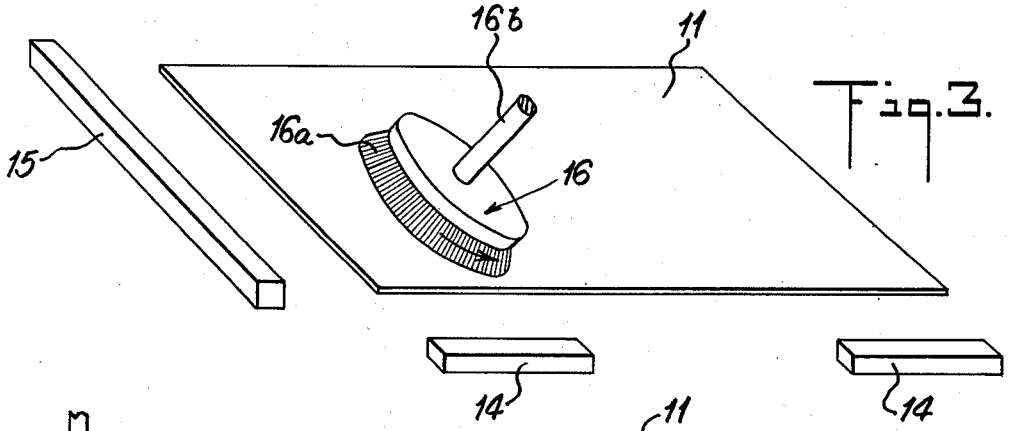
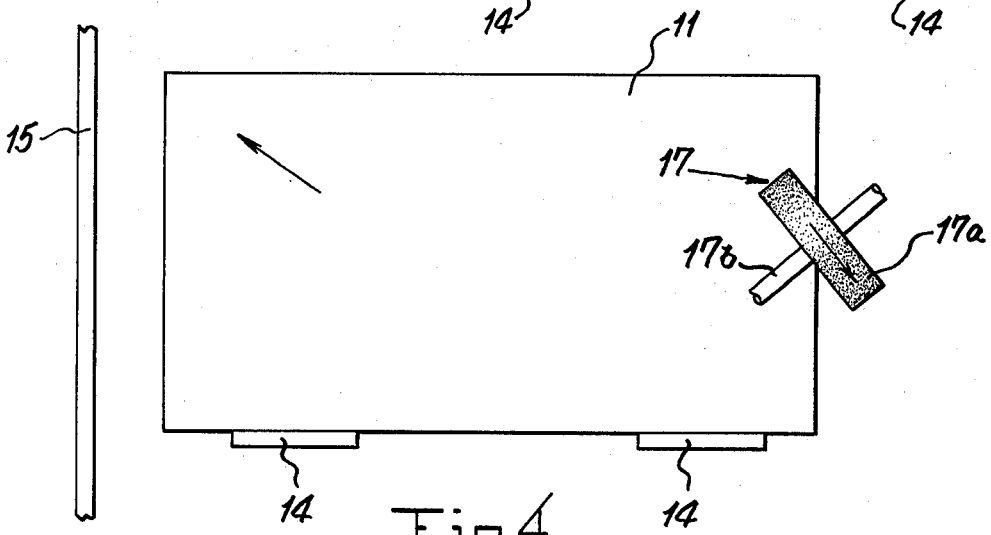
Fig.4.
Fig.5.
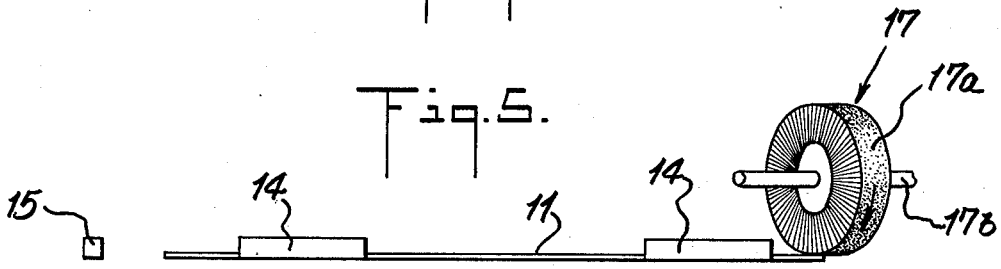

SHEET REGISTRY DEVICE

BACKGROUND OF THE INVENTION

The device of the present invention embodies a rotary brush which operates on a moving sheet to push such sheet against a side guide and register it in position. It does not require a coacting movable element and depends on the sheet moving through the bristles of the brush.

U.S. Pat. No. 1,196,934 to Droitcour discloses a sheet registering mechanism employing two brush arrangements, namely infeed and side registry. The latter is intended to perform the same function as the side registry device of the present invention. However, the Droitcour device depends on linear brush movement, operates on a stationary sheet, requires a coacting movable element below the sheet, and must be out of way for sheet movement in direction perpendicular to registration direction. The device of the present invention is inherently simpler and is used where the sheet is being positively urged forward by a pusher device (slat), such pusher device being free to pass through the side registration brush without incident.

U.S. Pat. No. 2,422,629 to Miller discloses a method of braking a sheet to prevent rebound after it has been propelled against a stop. The brush is free wheeling in the paper feed direction and thus the sheet drives the brush. The brush is prevented from rotating in the opposite direction and thereby provides the braking action which is sought. The device operates in the direction of travel of the sheet.

U.S. Pat. No. 2,181,241 to Klemm discloses a device that essentially changes the direction of travel of a sheet. It depends on engagement of the leading edge of the sheet, whereas the device of the present invention is oriented to the side of the sheet. The Klemm device, as with Droitcour, requires cooperating elements above and below the sheet to accomplish the movement. The brush mentioned in Klemm would not be as successful as the other frictional combinations disclosed for changing such sheet direction.

The differences outlined with reference to the prior patents serve to distinguish the device of the present invention from the devices disclosed in such patents.

SUMMARY OF THE INVENTION

It is an object of the invention to provide a rotating brush device which registers a moving sheet against a side guide in a sheet-handling machine.

It is a further object to provide a rotating brush device in which the brush is so angled and positioned that it permits easy entry of a moving sheet under the brush and exerts a force on the sheet which moves such sheet toward a side guide.

It is a further object to provide a device which permits passage of the sheet moving element (slat) through the registering element without the need for a timed movement of the registering element out of the way of the sheet moving element.

It is a further object to provide a rotating brush device to register a moving sheet against a side guide which is simple and economical to manufacture and operate and is efficient and well suited for its intended purpose.

BRIEF DESCRIPTION OF THE DRAWINGS

Other objects and advantages will become apparent from the following description which is to be taken in conjunction with the accompanying drawings, in which:

FIG. 2 is a rear elevation of the sheet in position C of FIG. 1 showing the angular position of the brush with the bristles along the outer circumference of the brush contacting the top surface of the sheet;

FIG. 3 is a perspective view showing the sheet after it has been fed under the rotary brush positioned near the center surface of the sheet and before the sheet has been registered against the side guide by the force exerted by the brush;

FIG. 4 is a top plan view showing a cylindrical form of brush directed against the outer edge of the sheet; and FIG. 5 is a rear elevation of the brush and sheet of FIG. 4.

DESCRIPTION OF THE PREFERRED EMBODIMENT

Figure 1:
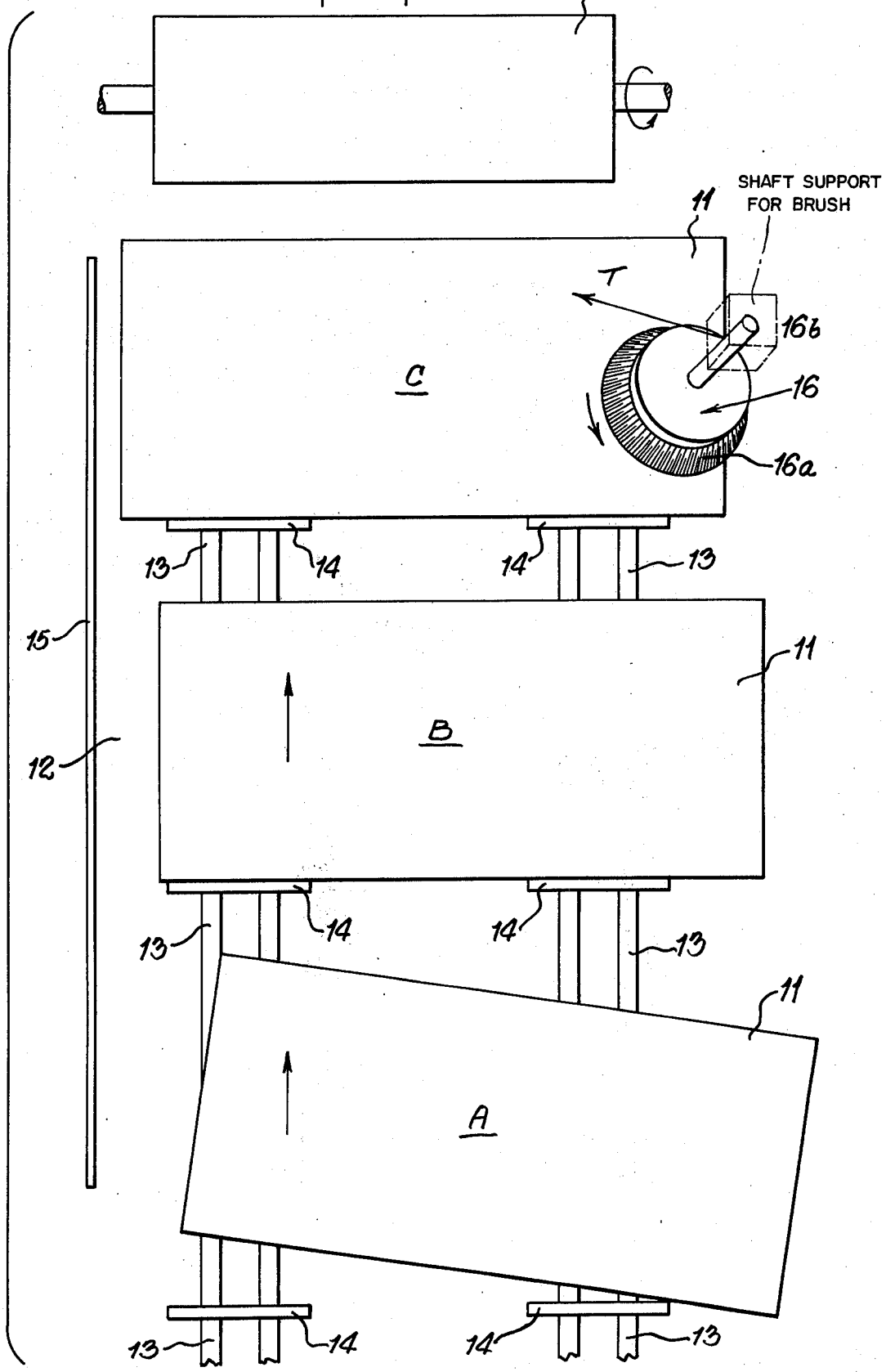
FIG. 1 is a top plan view showing a sheet in Position A after being fed onto the conveyor or press table at random, a sheet in position B aligned in a machine direction by the slats, and a sheet in position C directed over to the side guide by the force of the rotary brush exerted on the outer edge of the sheet, which force aligns the sheet in a cross-machine direction preparatory to being fed into a print cylinder.

Referring to the drawings, there is shown in FIG. 1 apparatus for feeding sheets into a print cylinder 10 where the sheets must be aligned both in the cross-machine and machine directions to insure proper registry preparatory to printing. Although this sheet-handling apparatus has particular application for printing presses it will be understood that it also has application for other operations where the sheet must be properly aligned, such as stitching, laminating, etc. The sheets 11 are laid on a press table 12 with a conveyor 13 which has spaced slats 14 moving in the machine direction. The slats 14 engage the rear edge of each sheet or board and thus align the sheet perpendicular to the machine direction. At this stage, the sheet is not aligned or positioned in a cross-machine direction. The rotary brush of the present invention will serve to align such sheet in a cross-machine direction by exerting a force against the sheet and pushing it against a side guide 15. The sheet will thus be aligned in both the machine and cross-machine directions.

Further referring to FIG. 1, the sheet 11 in the A position has been laid on the press table at random and is not aligned in any direction. The spaced slats 14 contact each side of the back edge of the moving sheet thus aligning the sheet in the machine direction as shown in position B. At this stage the sheet will not be aligned with side guide 15, except by chance. The moving sheet now passes through the bristles **16*a* of the rotary brush 16. The brush is constantly rotating and has stiff bristles which contact the edge of the sheet farthest from the side guide or the top of the sheet. The shaft 16*b*** of the brush is inclined from the perpendicular to the plane of the sheet so that the sheets may enter under the brush without resistance and thereafter be acted upon only by the bristles at the single point of contact. Furthermore, the shaft is tilted with respect to the machine direction line of travel so that the moving bristles will urge the sheet both in the machine direction and toward the side guide. It is possible to control the direction of the force applied by the brush by altering the attitude of the brush relative to the blank. As the brush orbits about a pivot point on the drive end of the shaft, the attitude of the bristles in contact with the board is altered. This allows control of the direction of the registering force. If a tangent were drawn at the outer circumference of the brush at approximately the center of the area of contact of the brush against the sheet, such tangent would represent the direction of force on the sheet. Such direction of force and the forward movement of the conveyor causes the sheet to move toward the side guide.

Considerable variation of the brush position is possible without affecting the efficiency of the device in urging the sheet against the side guide. For example, the shaft of the brush can be tilted from the perpendicular to the plane of the sheet within a range of approximately 5° to 30° from such perpendicular. If the shaft is tilted less than 5° the bristles are almost perpendicular and will not exert a positive force in the desired direction. If the shaft is tilted more than 30°, there are not enough bristles making contact with the sheet. With regard to the tangent or direction of force exerted by the brush, as described above, such angle can vary within a range of approximately 0° to 45° from the perpendicular to the direction of machine travel, with the ideal at about 20° to 25°. As the angle increases, the component of the force vector which urges the sheet toward the side guide diminishes while the risk of failure to move the sheet and the time required to reach the side guide both increase.

In FIGS. 1 and 2 the brush is shown as rotating in a counter-clockwise direction with the upper portion of the circumference of the bristles in the 0° to 90° quadrant contacting the sheet. The tangent T is thus directed at an angle toward the side guide. It will be understood that the brush can also be rotated in a clockwise direction with the lower portion of the circumference of the bristles in the 180° to 270° quadrant contacting the sheet. The tangent will then be parallel to tangent T at the lower portion of the brush. The angle again would be toward the side guide. In such case entry of the sheet under the brush will be more difficult.

In FIG. 1 the brush is contacting the edge of the sheet farthest from the side guide. However, the brush will also operate effectively if it contacts the top surface of the sheet at other positions on the sheet, for example as shown in FIG. 3.

Instead of the brush having the generally flared or conical shape shown in FIG. 1, such brush 17 can be cylindrical with its axis mounted parallel to the plane of the sheet, as shown in FIGS. 4 and 5, with the bristles 17*a* against the top surface of the sheet. The shaft 17*b* of the brush can be mounted on a yoke with an inverted gimbal so that it can swivel on a vertical axis. The direction of the registering force can be varied and controlled by movement about such vertical axis. In such case the rotation of the cylindrical brush will be directed in substantially the same path as tangent T shown in FIG. 1.

The operation of the side registry device should be apparent from the foregoing description. Thus among others, the several aforenoted objects and advantages are most effectively attained. Although a somewhat preferred embodiment of the invention has been disclosed and described in detail herein, it should be understood that this invention is in no sense limited thereby and its scope is to be determined by that of the appended claims.

Having thus described the invention, what is claimed is:

1. A sheet registry device in a sheet-handling machine for aligning a sheet in a cross-machine direction comprising:

means to support a sheet and convey such sheet aligned in a machine direction;

a side guide positioned to align a sheet in a cross-machine direction;

a constantly rotating brush having projecting bristles positioned in the path of the moving sheet and adapted to receive the sheet thereunder;

a shaft for said brush positioned above said sheet to provide an oblique direction of rotation of said brush with respect to the edge of said sheet;

supporting means to support said shaft;

said shaft being tilted within a range of 5° to 30° from the perpendicular to the plane of the sheet and being angularly positioned so that the bristles in the outer edge of said brush exert a force on the top surface of the sheet and move said sheet in the direction of the side guide solely by the rotation of said brush;

the ends of the bristles of the rotating brush exerting a force against the top surface of the sheet in a direction toward said side guide, the said force being sufficient to move the sheet from an edge thereof and still permit easy passage of the moving sheet through the bristles;

whereby the said sheet will be urged against the side guide and be aligned in a cross-machine direction.

* * * * *